United States Patent [19]

Salmon

[11] Patent Number: 4,487,385

[45] Date of Patent: Dec. 11, 1984

[54] METHOD OF CONTROLLING A RAILROAD CAR IN AUTOMATIC DRIVE

[75] Inventor: Jean P. Salmon, Aulnay sous Bois, France

[73] Assignee: Jeumont-Schneider, France

[21] Appl. No.: 342,777

[22] Filed: Jan. 26, 1982

[30] Foreign Application Priority Data

Jan. 29, 1981 [FR] France ..... 81 01671

[51] Int. Cl.[3] ..... B61L 25/00

[52] U.S. Cl. ..... 246/122 R; 246/34 R; 246/63 R; 246/167 R; 340/941; 340/991; 340/994

[58] Field of Search ..... 340/23, 24, 47, 941, 340/988, 989, 991, 992, 993, 994, 996; 346/122 R; 246/34 R, 34 A, 34 CT, 63 R, 63 A, 63 C, 167 R, 187 B, 62

[56] References Cited

U.S. PATENT DOCUMENTS

| | | | |
|---|---|---|---|
| 918,537 | 4/1909 | Halvorsen | 340/23 |
| 3,333,096 | 7/1967 | Ohman | 246/122 R |
| 3,774,025 | 11/1973 | Auer, Jr. | 246/63 A |
| 3,821,544 | 6/1974 | Matty | 246/34 CT |
| 3,879,004 | 4/1975 | Andreasen | 246/62 |
| 3,891,167 | 6/1975 | Perry | 246/122 R |
| 3,907,237 | 9/1975 | Staples | 246/34 A |
| 3,979,092 | 9/1976 | Perry | 246/34 R |
| 4,325,524 | 4/1982 | Krug | 246/34 R |
| 4,351,504 | 9/1982 | Frielinghaus | 246/122 R |
| 4,373,691 | 2/1983 | Fricke | 246/34 R |

FOREIGN PATENT DOCUMENTS

| | | |
|---|---|---|
| 7271 | 1/1980 | European Pat. Off. . |
| 1294418 | 5/1969 | Fed. Rep. of Germany . |
| 2143849 | 2/1973 | France . |

*Primary Examiner*—John W. Caldwell, Sr.
*Assistant Examiner*—Michael F. Heim
*Attorney, Agent, or Firm*—Schwartz, Jeffery, Schwaab, Mack, Blumenthal & Koch

[57] ABSTRACT

A voltage variation detector is connected to a receiver which is associated with a transmitter inducing an alternating signal permanently in the rails of a railroad track and, accordingly, in a conductive loop positioned between the rails. The respective variations of the voltage induced in the loop and of a feeding voltage to the loop furnish redundant information of the presence of a car in the transmission zone.

8 Claims, 2 Drawing Figures

METHOD OF CONTROLLING A RAILROAD CAR IN AUTOMATIC DRIVE

BACKGROUND OF THE INVENTION

1. Field of the Invention

The present invention relates to a method of controlling a railroad car in automatic drive on an iron track. The track is divided into transmission zones, essentially independent of the sections of the track (at least when the track is of the "jointless" type).

2. Discussion of Related Art

A device for transmitting information through the rails of a track to a railroad vehicle or car running on the track is described in French Pat. No. 2,431,409. This device is made up of, on the track for each information transmission zone:

an A.C. signal generator alternating at a predetermined frequency which constitutes the carrier frequency for the information transmitted to the cars, this frequency being chosen to be outside of the frequency bands used in track circuits.

a signal modulator, a command module for controlling the modulator in such a way that the carrier signals are modulated as a function of the information to be transmitted, at least one isolated conducting loop arranged in the form of a frame between the two lines of rails, near the extreme downward part of the information transmission zone, an isolation and impedance matching transformer connected such that the primary receives the modulated signals and such that the secondary connects to the terminals of the loop, two resonating circuits, having resonant frequencies equal to the carrier frequency, connected between the two lines of rails, one being at the extreme downward part and the other being at the extreme upper part of the information transmission zone, and at an end of each car, reception means having the same frequency as the carrier frequency.

SUMMARY OF THE INVENTION

The method according to the present invention operates similarly to the above device; however, beyond its information transmission functions, the present invention has the advantage of permitting the detection of a car running in the transmission zone by the addition of a limited number of components.

According to the present invention, a receiver, placed at an end of the railroad car, is connected to a voltage variation detector which permits the precise detection of its passage above an element of a conducting loop arranged between the two rails. Further, a transmitter using a second frequency is likewise put on board and is arranged in a manner to induce a current in the railroad tracks and, consequently, in the conducting loop. In order to transmit the variations of the induced voltage, two resonating circuits having resonant frequencies equal to the second frequency are connected between the two lines of the track in addition to the two first resonating circuits.

The alternating voltage feeding of the loop provides redundant negative information of the presence of a car in the transmission zone.

The method of the present invention has the advantage of using the existing control devices and can be used on the circuits of a conventional track. Further, it serves to ensure that at an end of each car, necessary kilometer counter corrections can be made to provide the precision which is required for automatic control, and to deliver to a central command post redundant information indicating the location of all cars at every moment on the track. Such location information is very important if one wishes to control the distance between the cars.

BRIEF DESCRIPTION OF THE DRAWINGS

Other goals, advantages and characteristics of the invention will appear more clearly as the invention becomes better understood in accordance with the detailed description which follows in which like reference numerals represent like parts throughout and in which.

DETAILED DESCRIPTION OF THE PREFERRED EMBODIMENT

Figure 1:
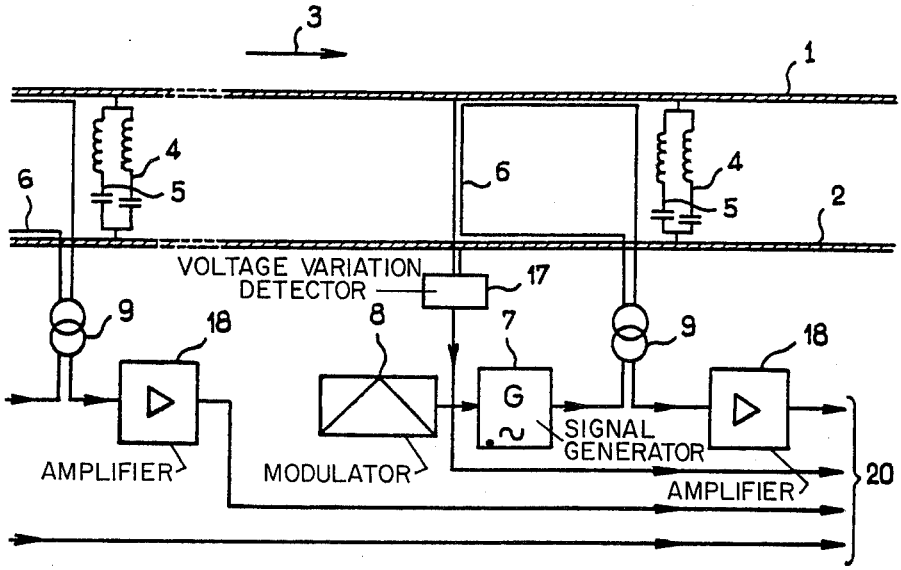
FIG. 1 represents schematically the circuitry connected to the track.

In reference now to the figures, the direction of the gradual approach of the railroad cars on the rails 1 and 2 of the iron track is indicated by the arrow 3. Information zones are established independently of the sections of the railroad track, if the track circuits are of the jointless type, or on the interior of the sections, if the railroad track is of the jointed type. The information transmission zones are defined by a succession of shunts 4, 5 which are conventional resonating circuits, having resonant frequencies used for transmission and control. These frequencies are chosen to be different from the frequency bands used for the track circuits. A loop 6 is arranged between the lines of track 1 and 2 immediately near the further shunt. This loop 6 is fed through a transmitter having an A.C. generator 7 providing a carrier wave for information transmission and connected to a modulator 8. The modulated signals are applied to the loop 6 through the intermediary of an isolation and impedance matching transformer 9 playing the role of an impedance adapter and circuit isolator. The loop 6 induces an alternating signal into the rails which is received at the end of the train 16 entering into the zone of transmission, the receiving part of two transmitter-receivers 10 and 11 which are provided in the lower part of front wheels 12, 13. Wheels 12 and 13 form a shunt across lines 1, 2 of the track through the intermediary of the axle 14. The use of two transmitter receivers is advantageous in order to allow operation in a differential reception mode, hence providing a more certain signal from the apparatus on the car. Conversely, the transmitting part of the transmitters-receivers 10, 11 on board permanently emits an alternating signal which is induced into rails 1, 2 and, because of that, is received by the loop 6. An A.C. generator 15 is put on board for that purpose.

The functioning of the control device is as follows: when a train 16 enters into the transmission zone, that is to say when its first axle has passed the shunts in the front 5, 6 of the zone, its approach is positively detected due to the signal emitted by the transmitting part of the transmitters-receivers 10, 11 put on board the car 16. This signal is induced in the loop and is detected and amplified by the amplifier 18 functioning in a non-inverting mode. In addition, the current delivered through the generator on the ground is controlled to permit protection of the installation, and to allow the feeding voltage of the loop to fall in response to the approach of the train. A voltage variation detector 17 connected between the lines of the rails before the loop advantageously uses this property in order to deliver negative information of the presence of the car. The combination of the positive and negative information signals indicating the presence of the car enables a device on the ground to interrupt the emission of control information in the section of the present transmission, and to emit the information in the next section, thereby ensuring the continuity of the transmissions to the receivers on board the train.

When the front of the train 16 passes over each of the crossing or transverse parts of the loop 6, detectors in the receivers on board are in the position to detect them with precision and to permit the train to correct its information regarding its position. Likewise, the crossing of the transmitters on board over the loop allows the device on the ground to detect with precision the position of the train. This information is transmitted, respectively, on the ground to a central control station 20, not represented, and on the train to a single piloting station 21. According to this method, the information emitted in a determined zone is only available to a train traveling in the zone since the presence of the train hinders the signals from spreading behind it. The fact that there is no lengthwise transmission possible means that one can use a single frequency to feed the different loops 6 of the same iron track.

Figure 2:
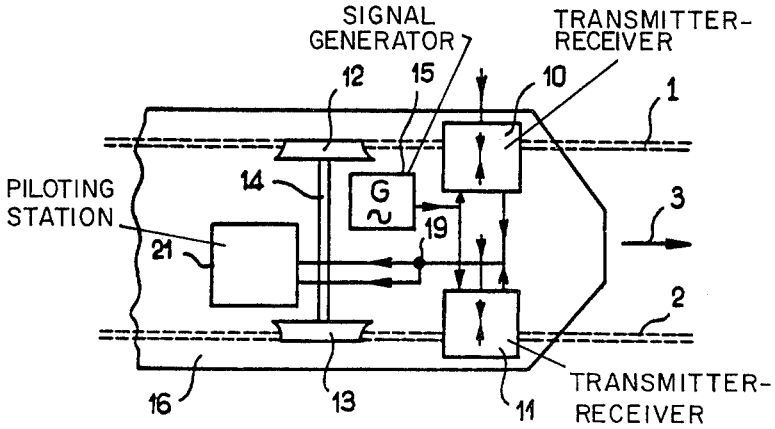
FIG. 2 represents schematically the circuitry on the train.

Within the framework of the redundant control information, it would be useful to further include in a line of cars a complementary transmitter at the end of each car, inasmuch as the transmission from this transmitter would not be received in the form of an induced voltage in the loop during the passage of the car above the loop but only after passage of the car. This information adds to the information concerning the detection of the approach of the car in a downstream zone through the two means described above to furnish a redundant signal indicating departure of the car from the transmission zone. Such a redundant transmitter would be the same as the transmitter of FIG. 2.

Although one method of realizing the invention has been described, it should be evident that all modifications, additions or other changes which would be obvious to one of ordinary skill in the art would come within the scope of the invention as set forth in the appended claims.

What is claimed is:

1. A method of presence and position detection of a train automatically running on a pair of metal tracks, said tracks being divided into information transmission zones defined by resonant shunts across the tracks; a ground station having a conductor loop with transverse sections arranged between said tracks in one zone, a source of modulated information signals being connected to said loop; said train being equipped with a receiver for receiving modulated signals from said loop, and a transmitter, said method comprising on said train:

generating an A.C. voltage, inducing said voltage in said tracks and transmitting said induced voltage through said tracks to said loop; and receiving said modulated information signals and, using said received modulated information signals, detecting when said train passes directly over said transverse sections of said conductor loop to produce a train position signal; and at said ground station:

receiving said induced voltage in said loop to produce a positive indication of the passage of said train into said zone; and monitoring the voltage of said modulated information signals produced across said tracks by said source and detecting a variation in said voltage due to a load variation when said train enters said zone to produce a negative indication of the passage of said train into said zone.

2. The method according to claim 1 including receiving said modulated signals in said receiver in a differential mode.

3. The method according to claim 1 and further including transmitting a second signal from the rear of said train to provide a redundant signal of departure from a zone.

4. The method according to claim 1 and further including the step of detecting the crossing of the transmitter onboard said train over said loop to permit said ground station to detect the position of said train.

5. A system for presence and position detection of a train automatically running on a pair of metal tracks, said tracks being divided into information transmission zones defined by resonant shunts across the tracks, said system comprising a ground station for one zone, comprising:

a conductor loop with transverse sections arranged between said tracks in said one zone;

a source of modulated information signals connected to said loop;

means for monitoring the voltage of said modulated information signals produced across said tracks and detecting a variation in said voltage due to a load variation when said train enters said zone to produce a negative indication of the passage of said train into said zone; and means for receiving induced voltage variations in said loop produced by signals transmitted from said train to produce a positive indication of the passage of said train into said zone; and on said train:

means for producing an A.C. voltage signal and transmitting said A.C. voltage signal through said tracks to produce said voltage variations in said loop; and means for receiving said modulated information signals and using said received modulation information signals to detect when said train passes directly over said transverse sections of said conductor loop to produce a train position signal.

6. A system as set forth in claim 5 wherein said receiving means on said train comprises two receivers to permit operation in a differential reception mode.

7. The apparatus according to claim 5 including a second producing and transmitting means mounted on the rear of said train to provide a redundant signal of departure from said zone.

8. The apparatus according to claim 5 wherein said monitoring means at said ground station includes means for detecting the passage of said train directly over said transverse sections of said loop.

* * * * *